US008666075B2

(12) United States Patent
Daniel et al.

(10) Patent No.: US 8,666,075 B2
(45) **Date of Patent: *Mar. 4, 2014**

(54) SYSTEM AND METHOD FOR IMPROVING IN-GAME COMMUNICATIONS DURING A GAME

(75) Inventors: Isaac Sayo Daniel, Miami, FL (US); Michael Stibilla, Lake Mary, FL (US)

(73) Assignee: F3M3 Companies, Inc., Miramar, FL (US)

( * ) Notice: Subject to any disclaimer, the term of this patent is extended or adjusted under 35 U.S.C. 154(b) by 541 days.

This patent is subject to a terminal disclaimer.

(21) Appl. No.: 12/317,640

(22) Filed: Dec. 23, 2008

(65) Prior Publication Data

US 2010/0080389 A1 Apr. 1, 2010

Related U.S. Application Data

(63) Continuation-in-part of application No. 12/286,476, filed on Sep. 30, 2008.

(51) Int. Cl.
*H04L 29/06* (2006.01)

(52) U.S. Cl.
USPC ..... 380/270; 380/251; 380/255; 380/271; 455/73

(58) Field of Classification Search
USPC ..... 380/251, 255, 270, 271; 455/73
See application file for complete search history.

(56) References Cited

U.S. PATENT DOCUMENTS

| | | | | |
|---|---|---|---|---|
| 5,646,589 | A * | 7/1997 | Murray et al. | 340/7.58 |
| 6,346,890 | B1 * | 2/2002 | Bellin | 340/9.11 |
| 7,171,553 | B2 | 1/2007 | Rix et al. | |
| 7,702,101 | B2 | 4/2010 | Malcolm et al. | |
| 2002/0132211 | A1 * | 9/2002 | August et al. | 434/247 |
| 2005/0212202 | A1 * | 9/2005 | Meyer | 273/108 |
| 2006/0025214 | A1 * | 2/2006 | Smith | 463/30 |
| 2007/0143382 | A1 * | 6/2007 | Luster | 708/100 |
| 2007/0290801 | A1 * | 12/2007 | Powell | 340/7.55 |
| 2008/0317263 | A1 * | 12/2008 | Villarreal, Jr. | 381/120 |
| 2010/0002882 | A1 * | 1/2010 | Rieger et al. | 380/270 |
| 2010/0077536 | A1 * | 4/2010 | Daniel et al. | 2/425 |
| 2010/0080390 | A1 * | 4/2010 | Daniel | 380/271 |
| 2010/0161984 | A1 * | 6/2010 | Pauker et al. | 713/168 |
| 2011/0246579 | A1 * | 10/2011 | Williams | 709/206 |
| 2012/0122069 | A1 * | 5/2012 | Coleman | 434/365 |
| 2013/0052943 | A1 * | 2/2013 | Black | 455/11.1 |

* cited by examiner

*Primary Examiner* — Nathan Flynn
*Assistant Examiner* — Sarah Su
(74) *Attorney, Agent, or Firm* — Carol N. Green, Esq.

(57) ABSTRACT

The present invention is directed to a system and method for improving communications between players and coaches during a sporting event, more specifically allowing coaches to dynamically transmit secure real-time communications of an intended game plays in text, visual, sketch and/or verbal format to their players or other coaches on/off the field to be effected on the field during a game.

23 Claims, 4 Drawing Sheets

SYSTEM AND METHOD FOR IMPROVING IN-GAME COMMUNICATIONS DURING A GAME

PRIORITY CLAIM

The present application claims priority to, and is a Continuation in Part of United States Non-Provisional patent application, application Ser. No. 12/286,476 titled: An Apparatus And Method For Improving In-Game Communications During A Game, filed Sep. 30, 2008. The entire disclosure of said Non-Provisional patent application is incorporated herein by reference.

FIELD OF THE INVENTION

The present invention is directed to a system and method for improving in-game communications, more specifically allowing coaches to dynamically transmit communications of game play instructions in real-time to other coaches and or team players on or off the field for execution during the game.

BACKGROUND OF THE INVENTION

Some sports allow coaches and/or individual players to call certain plays, i.e. game strategies, during the game, e.g. basketball, baseball, soccer, volleyball, paintball and football. In football, for example, the players are each required to learn all the "plays" in a playbook so that at game time, a coach can selectively call certain plays with minimal instructions to be executed on the field. However, these games have not been able to capitalize on technological advancements in the communications field as the method of communicating the game plays still relies heavily on (a) verbal communications in a huddle; (b) running the plays over speakers; (c) hand signals; or (d) a carefully scripted playlist on an armband, wristband or waistband.

The problem with the foregoing methods of communications is that they each have their limitations in providing efficient and secure transmissions. For example, a coach's instructions in a huddle can be overheard and even broadcasted live to the public at large when a game is being televised. In football, calling the plays via speakers are generally not known for their reliability as on occasion, the transmission is garbled, interrupted, or the external noise level on the field is so high that the recipient cannot hear the play. As for hand signals that are transmitted either from the sidelines, on the court or on the field, both the hand signals and the resulting plays are heavily watched by the opposing team to anticipate and counter the play. This is especially true if a coach repeatedly uses the same hand signals to run certain plays. In that event, the opposing team will counter the play by calling its own plays, run interferences and/or intercept the ball.

The problem is exacerbated when a player confuses the hand signals and compromises the play by executing something other than the intended game play. For example, a football coach may signal the quarterback from the sidelines to execute "WR 64," i.e. "Wide Right 64" requiring the wide receiver to run wide and pass on the right. If the quarterback misinterprets the hand signals and instead runs narrow to the left, he may be exposed for interception, a tackle, and/or side out.

Players and coaches alike are very aware of the foregoing limitations and some players, e.g. football players, have resorted to wearing an extra wide wristband or waistband made of stretchable material with a Velcro® strap that unfolds to reveal a panel where the game plays are committed in writing for quick review. Except, in the heat of the game the margin for error is still high as the player must unfold the wristband or waistband and review several plays before identifying the intended game play, all within a matter of seconds. Thus, there is a need for a system and method of transmitting secure transmissions of play instructions in real-time to the players on the field in a format that may be readily received, easily interpreted and universally understood by the players.

There is also need for creating a level playing field in sports, adding interest and intrigue to the games as neither team is made privy to the private communications of game plays between players and/or their coaches during the game.

This invention satisfies these long felt needs and solves the foregoing problems that the prior art has been unable to solve in a new and novel manner.

SUMMARY OF THE INVENTION

The present invention relates generally to a system and method for improving in-game communications for a sporting event or game using a portable remote terminal ("PRT") which may be used for any one or more of the following games, which includes but is not limited to: football, baseball, volleyball, soccer, paintball and basketball or any other games wherein a player is permitted to communicate with other team players and/or coach by using hand signals or voice signals.

The PRT is provided with means for activating the PRT, where the PRT receives a game play instruction for encryption by said portable remote terminal's microprocessor, which encrypts the received game play instruction forming an encrypted signal containing the received game play instruction. The PRT transmits in real-time the encrypted signal containing the received game play instruction, wherein the game play instruction is intended for execution on the field during the game. The received game play instruction may comprise of any one or more of the following formats: text, visual, sketch and audio.

Upon activation, the PRT's display element may display a plurality of game play instructions that are electronically stored thereon, from which a game play instruction may be selected for transmission. The plurality of game play instructions electronically stored thereon is stored in one or more of the following formats: visual and text. However, a coach and/or another team player may opt instead to provide a verbal game play instruction to the PRT for transmission to a team player and/or another coach. If the game play instruction was received verbally over speakers which are electrically or wirelessly connected to the PRT, the PRT's speech recognition means receives the verbal game play instruction and converts the verbal game play instruction to machine-readable input so that the converted verbal game play instruction may be displayed on the PRT's display element for viewing in text and or visual format. The speech recognition means comprises of a user interface which includes an audio receiving circuit capable of receiving audio signals at predetermined frequencies and/or additional hardware complete with electronic circuitry as are well known and used in the arts to effectuate the same.

In one embodiment of the invention, another coach or player is providing a game play instruction to another coach or player, i.e. a first recipient, who will in turn forward the game play instruction to either another coach or player on or off the field, i.e. a second recipient. In that event, the PRT's communication means receives an encrypted signal containing a game play instruction from an external source and the microprocessor decrypts the received encrypted signal containing said game play instruction. Upon receipt of the encrypted signal, the first recipient of the received game play instruction is alerted via the PRT's alarm notification means, which is capable of causing a vibration of the PRT, sounding an audio alarm; or flashing a light, visual or text of the decrypted signal containing the game play instruction on the display element. Depending on how the first recipient was alerted of the incoming game play instruction, the first recipient may then activate the PRT's display element, which displays the decrypted signal containing the received game play instruction.

The first recipient may accept the received game play instruction in which event the PRT receives the game play instruction being routed to a second recipient for encryption and the PRT's microprocessor encrypts the game play instruction to form an encrypted signal containing the game play instruction being routed to a second recipient and transmits in real-time said encrypted signal containing the selected game play instruction being routed to a second recipient, where the game play instruction is intended for execution on the field during the game on the field or court.

However, the first recipient may reject the received game play instruction and instead provide an alternate game play instruction. In that event, the PRT receives the alternate game play instruction, which may include any one or more of the following: one of a plurality of game play instructions stored thereon, a text message, a visual, sketch or a verbal game play instruction. Where the alternate game play instruction is verbal, the PRT receives the alternate verbal game play instruction and converts said alternate verbal game play instruction to machine-readable input using speech recognition means.

The PRT further includes a circuit board, battery, microprocessor, reject button, activation means, antennae and wiring for the transmission and receipt of text messages and/or visual displays. The circuit comprises of a circuit board having a microprocessor positioned thereon and electrically connected to communication means for receiving and transmitting the encrypted signals containing the game play instructions. The PRT communicates with other PRTs on the same team via its communication means, which employ short range wireless protocol and may comprise of a transceiver with integrated radio and shared antennae, or direct conversion receivers; digital radio receivers; super heterodyne receivers; or any other receivers or transceivers that are well known and used in the arts. Said communication means may include but is not limited to Blue Tooth, ZigBee, 802.11 series, or any other short range wireless protocol that is well known and used in the arts and other future short range wireless protocol suitable for transmitting data over a short distance. The PRT may comprise of a cell phone, computer, laptop, PDA and/or other WLAN communication devices that are readily used in the arts to transmit and/or receive wireless communications, which is specially adapted with software and hardware to implement the system and method of the invention.

The alarm notification means may comprise of a vibration motor electrically connected to the circuit board capable of causing a vibration of the PRT, or may include Dual-tone multi-frequency ("DTMF") decoders also electrically connected to the circuit board and speaker capable of sounding an audio alarm; a single tone alert system sounding an alarm like a Sonalert; or the microprocessor electrically connected to the display element programmed to flash a light thereon on receipt of the encrypted signal of the game play instruction. In this manner, the alarm notification means may cause a vibration of the game apparatus, sound an alarm or flash a display on the display element, thereby alerting the recipient of the received encrypted signal.

The microprocessor decrypts the encrypted signal for the game play instruction for displaying either a text message and/or a visual display on the display element. The display element may be a liquid crystal display ("LCD") or light emitting diode ("LED") type, plasma, touch screen or other types of displays that are well known and used in the arts. The display element will display the game play instruction either in text and/or visual format for a few seconds, e.g. 10 seconds, before ending the display. Additionally, the display element may optionally be activated via the PRT's activation means.

The activation means may include an activation button, which may be used to at least one of, activate and reactivate the display element to display the decrypted signal of the intended game play on the display element of the invention. The PRT may also be activated by voice commands in which event the speech recognition means converts the voice commands to activate the PRT. Additionally, the PRT may be activated using touch screen technology, where by touching the screen various functionalities of the PRT can be activated and/or employed.

A primary object of the present invention is to provide a system and method for improving in-game communications between players and/or coaches during a game that overcomes the limitations of the prior art.

A primary object of the present invention is to provide a system and method of providing speedy real-time in-game communications between players and/or coaches during a game that overcomes the limitations of the prior art.

Another object of the present invention is to provide a system and method which uses an alarm notification means to alert a player or a coach of the receipt of confidential transmissions of game play instructions from another coach or player.

Still yet another object of the present invention is to provide a PRT which includes a circuit board, battery, microprocessor, activation switch, speech recognition means and wiring.

Yet another object of the present invention is to provide a system and method for providing secure communications between players and/or coaches.

Additional objects of the present invention will appear as the description proceeds.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Further objectives and advantages of the present invention may be derived by referring to the detailed description and claims when considered in connection with the Figures, wherein like reference numbers refer to similar items throughout the Figures.

DETAILED DESCRIPTION OF THE PREFERRED EMBODIMENT

Figure 1:
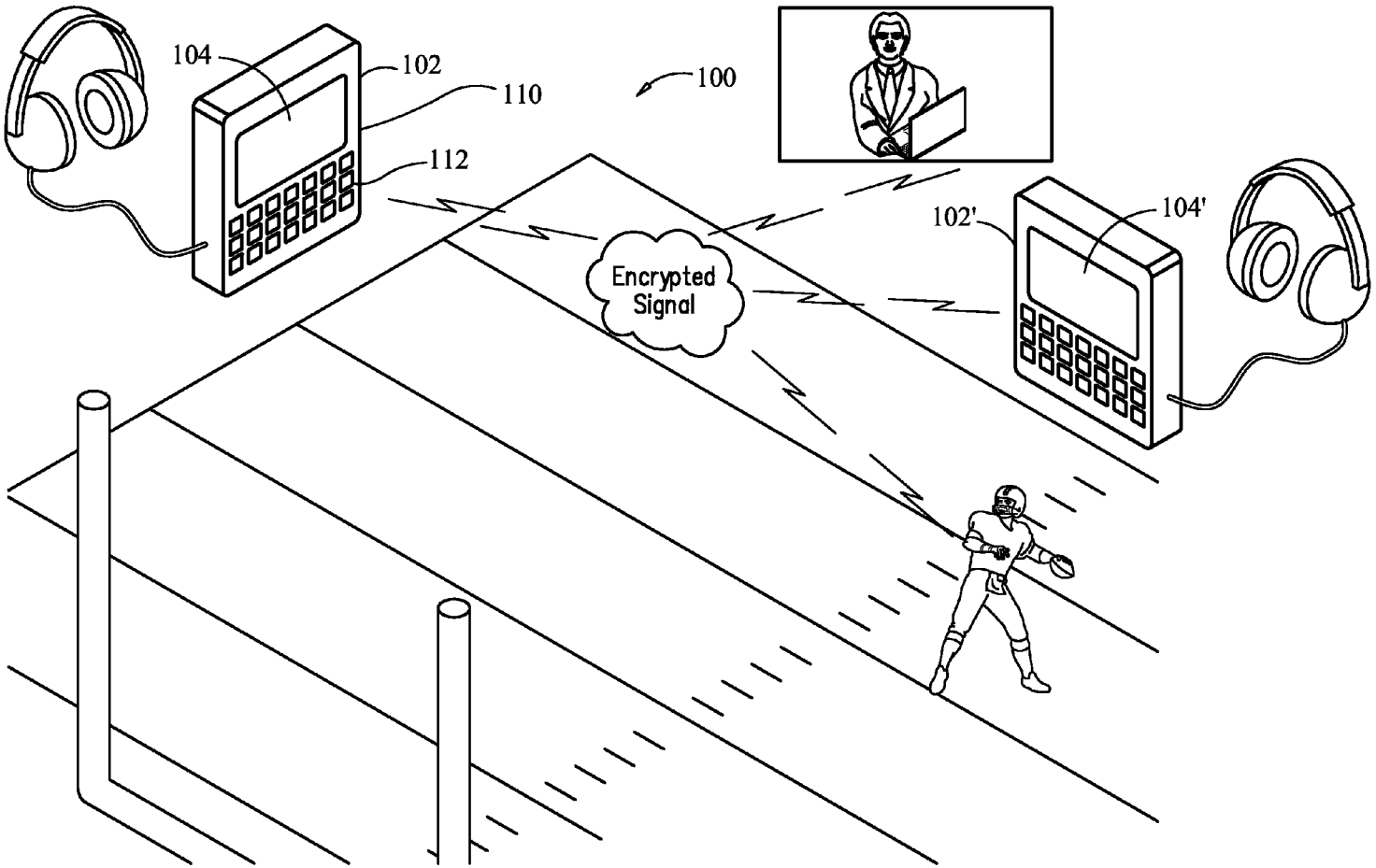
FIG. 1 shows an illustrative view of a system of the invention according to an embodiment of the invention.

The following discussion describes in detail an embodiment of the system and method of the invention. This discussion should not be construed, however, as limiting the invention to those particular embodiments since practitioners skilled in the art will recognize numerous other embodiments as well. For definition of the complete scope of the invention, the reader is directed to the appended claims.

With respect to the drawings accompanying this specification, similar reference characters denote similar elements throughout the various views. While the invention as described below has been described in conjunction with football, it is understood that the PRT may be used for several other games or sporting events and may include but is not limited to: football, baseball, soccer, volleyball, paintball and/or basketball, or any other games which allows players to receive in-game communications.

Figure 2:
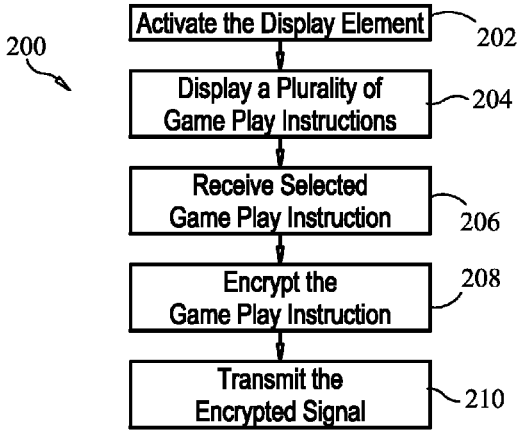
FIG. 2 is a flow chart illustrating a communication process according to an embodiment of the present invention.

Turning now to FIGS. 1 & 2 an illustrative view of a system 100 of the invention according to an embodiment of the invention and a communication process 200 according to an embodiment of the present invention are respectively shown. Illustratively, as a football game progresses a coach (or another player) on the field, in the viewing box or anywhere else on/off the field or in the nearby vicinity, may require for example, the team's quarterback to execute a particular game play instruction.

The PRT 102 is provided with a display element 104 adapted to display a plurality of game play instructions, which are electronically stored thereon on a storage medium such as ROM or RAM and may be displayed in visual and/or text format. As such, a coach or player may activate the PRT's display element 104 (step 202) to display a plurality of game play instructions (step 204) on the PRT's display element 104, e.g. a touch screen, which is provided with software to include a playlist in text, (shortened code or long form) and/or visual format. The display element 104 may include a liquid crystal display ("LCD") or light emitting diode ("LED") type, plasma, touch screen or other types of displays that are well known and used in the arts. From the plurality of game play instructions, a game play instruction may be selected for transmission in real-time to a player(s) and/or another coach (es) on or off the field.

Once a game play instruction is selected, the PRT's communication means 106 (not shown) receives the selected game play instruction (step 206) and the microprocessor 108 (not shown) encrypts the game play instruction (step 208) creating an encrypted signal containing the game play instruction for transmission. The PRT's communication means 106 (not shown) provides for the receipt and transmissions of wireless communications through a wireless communications network. The player and/or coach receiving the game play instruction may be wearing or carrying another PRT 102', or a game apparatus equipped with software and hardware adapted to communicate wirelessly via the transmitting PRT's communication means 106.

Said communication means 106 (not shown) and the microprocessor 108 (not shown) may comprise of a combined wireless transceiver with integrated radio and shared antennae, e.g. WiHLoN™, ZigBee, Blue Tooth, 802.11 series, or any other short range wireless protocol that is well known and used in the arts, and other future short range wireless protocol suitable for transmitting and receiving data over a short distance. Preferably, communication means 106 (not shown) and microprocessor 108 (not shown) include a combined wireless transceiver like a ZigBee transceiver with an integrated radio and shared antennae.

In certain embodiments of the invention, there may be more than one recipient, on or off the field, of the transmitted encrypted signal containing the game play instruction, which requires the coach or player transmitting the game play instruction to select the intended recipient(s). As such, the PRT's microprocessor 108 receives the selected recipient(s) (step 209, not shown) for targeted transmission. In other embodiments, the recipient may be limited to one other person, e.g. a quarterback on the field. In either event, the transmitting PRT's communication means 106 (not shown) transmits the encrypted signal (step 210) containing the game play instruction to the player(s) and/or another coach on or off the field, wherein the game play instruction is intended for execution on the field during the game.

Figure 3:
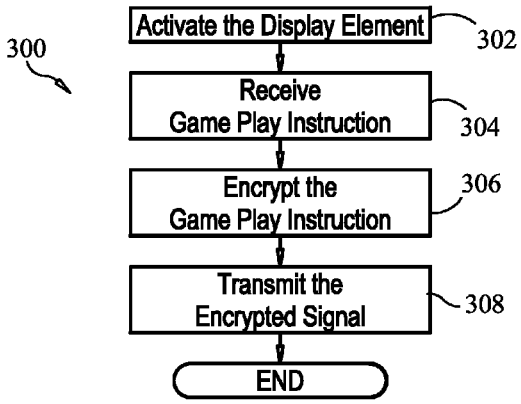
FIG. 3 is a flow chart illustrating a communication process according to an alternate embodiment of the present invention.

FIG. 3 is a flowchart illustrating a communication process 300 according to an alternate embodiment of the present invention. In this embodiment, a coach or player may choose to input the game play instruction in sketch and/or text format for execution by the players on the field. For example, a football coach or another player may input text in a shortened code or long form to execute "WR 64," or "Wide Right 64" respectively, requiring the wide receiver to run wide and pass on the right. Alternatively, the coach may sketch the desired game play instruction. In either event, using the PRT's activating means 110 the player/coach may activate the PRT's display element 104 to input a sketch or text of the game play instruction. The activating means 110 may include an activation button 112 (not shown), which may be used to at least one of, activate and reactivate the display element 104. The PRT 102 may also be activated by voice commands in which event the speech recognition means 114 (not shown) converts the voice commands to activate the PRT 102. Additionally, the PRT 102 may be activated using touch screen technology, where by touching the screen various functionalities of the PRT 102 can be activated and/or employed.

In one embodiment, PRT's microprocessor 108 is electrically connected the activation button 112 (not shown) for activating the display element 104 (step 302) to display the decrypted signal of the game play instruction thereon. The PRT's microprocessor 108 (not shown) receives the text message or sketch of the game play instruction (step 304) and the PRT's microprocessor 108 encrypts the game play instruction (step 306) for transmission of the encrypted signal containing the game play instruction to the player(s) and or another coach on or off the field (step 308).

Figure 4:
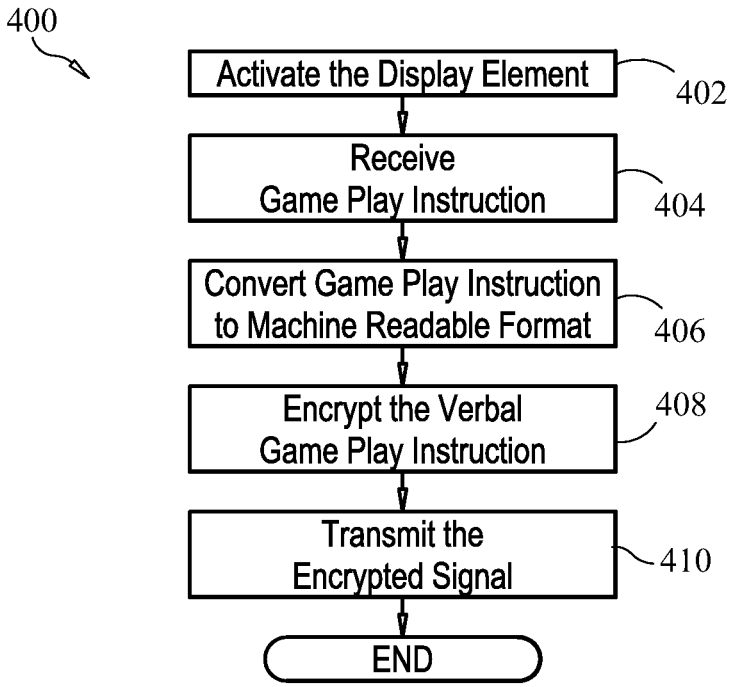
FIG. 4 is a flow chart illustrating a communication process according to another alternate embodiment of the present invention.

FIG. 4 is a flow chart illustrating a communication process 400 according to yet another alternate embodiment of the present invention. In this embodiment, a coach or player elects to provide a verbal game play instruction for execution by the player(s) on the field during the game. PRT 102 is equipped with speech recognition means 114 (not shown), which may be activated by a verbal game play instruction and/or a separate command, e.g. "ON." As such, after activation (step 402) the PRT's speech recognition means 114 receives the game play instruction (step 404) in audio format. The PRT's speech recognition means 114 (not shown) converts the verbal game play instruction (step 406) to machine readable format for encryption purposes. The microprocessor 108 (not shown) encrypts the converted verbal game play instruction (step 408), which is transmitted as an encrypted signal containing the game play instruction (step 410) by PRT's communication means 106.

Figure 5:
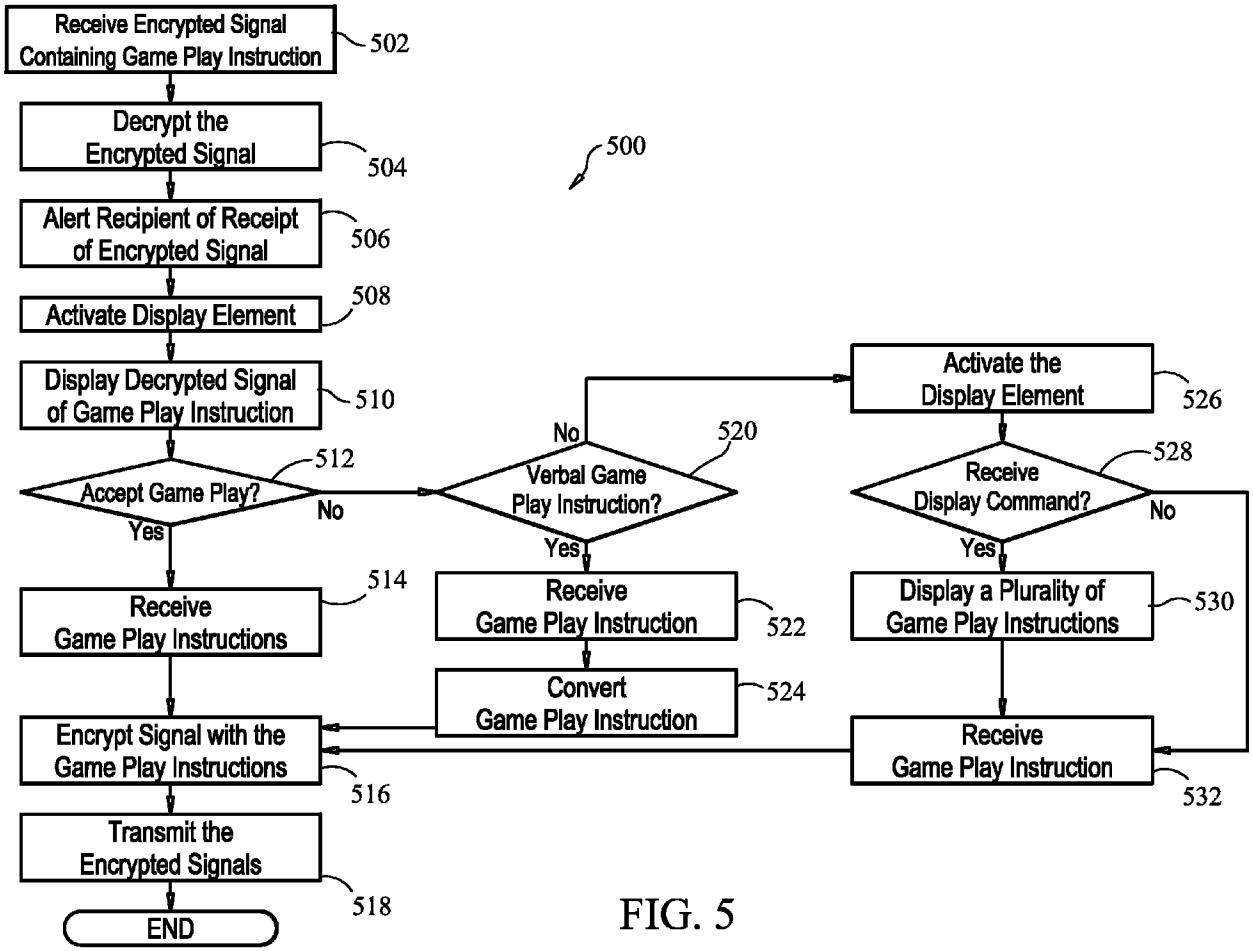
FIG. 5 is a flow chart illustrating a communication process according to yet another alternate embodiment of the present invention.

FIG. 5 is a flowchart illustrating a communication process 500 according to yet another alternate embodiment of the present invention. In this embodiment, a coach or player on or off the field may transmit an intended game play instruction to a first recipient, e.g. another coach or player for review, prior to the intended game play instruction being transmitted to a second recipient, e.g. another coach or player on or off the field. For example, a football coach in the sky box transmits a game play instruction to an offensive coach on the sidelines for that coach's review, prior to the game instruction being transmitted to the player on the field.

In that event, the first recipient's PRT's communication means 106 receives an encrypted signal containing the game play instruction from an external source, i.e. another coach or player (step 502). Prior to encryption, this game play instruction may've been in any format, i.e. visual, text, verbal or sketch format. The first recipient's PRT's communication means 106 receives the encrypted signal (step 502) containing the game play instruction and its microprocessor 108 (not shown) decrypts the received encrypted signal (step 504) containing the game play instruction for display on the PRT's display element 104, such that the received game play instruction may be viewed.

Upon receipt of the encrypted signal containing the game play instruction, alarm notification means 116 (not shown) alerts the recipient of the receipt of the incoming encrypted signal (step 506) containing the game play instruction for his/her review. (Alternatively, the alarm notification means 116 may also be used to notify the recipient of an incoming encrypted signal of a rejected play from a player on the field or another coach.) The alarm notification means 116 (not shown) may comprise of a motion sensor 118 (not shown) which enables the PRT's display element 104 upon sensing any movement by the holder of the PRT, or a vibration motor 120 (not shown) electrically connected to the circuit board 122 (not shown) capable of causing a vibration of PRT 102, or may include Dual-tone multi-frequency ("DTMF") decoders 124 (not shown) also electrically connected to the circuit board 122 (not shown) and speaker 126 (not shown) capable of sounding an audio alarm; a single tone alert system 128 (not shown) sounding an alarm like a Sonalert; or the microprocessor 108 (not shown) electrically connected to the display element 104 programmed to flash a light or the decrypted game instruction thereon on receipt of the encrypted signal of the game play instruction. In this manner, the alarm notification means 116 (not shown) is capable of causing a vibration of PRT 102, sounding an audio alarm or flash a light or the decrypted game instruction in visual or text format on the display element 104, thereby alerting the recipient of the received encrypted signal containing the game play instruction.

The display element 104 (not shown) may be programmed to activate the PRT's display element 104 (step 508) to display the decrypted signal (step 510) containing the game play instruction for a predetermined period, e.g. 10-20 seconds. The first recipient of the game play instruction may choose to reject or accept the decrypted game play instruction (step 512) using their PRT 102' or a game apparatus to communicate their rejection via their PRT's 102' rejecting means 130. The rejecting means 130 may include for example a "Reject button 132" (not shown) or a voice command or an input instruction on the PRTs' display element 104 or other known input means that are readily used in the arts.

If the first recipient chooses to accept the game play instruction in step 512, the first recipient may communicate acceptance by forwarding the received game play instruction to a second recipient i.e. another coach or player on or off the field. Accepting the received game play instruction may be accomplished by touching "Send" or a like instruction on the PRT's 102 touch screen display element 104, depressing a "Send" or like button on the PRT 102; or providing a verbal instruction to "Send" or a similar verbal instruction to the PRT 102 or any other voice commands and input means that are well known and readily used in the arts. In that event, the PRT 102 receives the game play instruction (step 514) for encryption and transmission to a second recipient and proceeding with steps 516-518.

If the first recipient rejects the received game play instruction, the first recipient may either select an alternate game play instruction from the plurality of game play instructions stored on the PRT 102, input a new game play instruction in either text and/or visual format or provide the same verbally. If the recipient decides in step 520 to provide an alternate verbal game play instruction, the communication means 106 receives the game play instruction (step 522), the speech recognition means 114 (not shown) convert the verbal game play instruction to machine The second recipient may reject the transmitted alternate game play instruction, which was transmitted verbally, visual, sketch and/or text. In that event, the second recipient may communicate their rejection of the received game play instruction by transmitting an encrypted signal containing the rejected game play instruction back to the first recipient and/or any other recipient authorized to receive the transmission. As such, a new series of game play instructions may be transmitted following the steps enumerated in FIG. 2, 3 or 4. Otherwise, the game play instruction will be expected to be executed on the field during the game. In this manner, the coaches' and players' communications are transmitted in a secure environment that will not be intercepted and/or overheard by the opposing team, spectators or the public at large.

If the recipient chooses not to give a verbal game instruction but instead wishes to select an alternate game play instruction from either the plurality of game play instructions stored thereon or provide a sketch of the alternate game play instruction, his PRT's display element 104, e.g. a touch screen, may be activated (step 526) to display the plurality of game play instructions on the display element 104. If one of a plurality of game play instructions will be selected, the PRT receives the display command (step 528) and displays the plurality of game play instructions as in step 530. Thus an alternate game play instruction can be selected from the plurality of game plays stored on his PRT 102, in which case the PRT 102 receives the game play instruction (step 532) which is then encrypted (step 516) to form an encrypted signal containing said game play instruction being routed to a second recipient and transmitted (step 518) as such.

If however, the recipient elects to input a visual sketch or text of the alternate game play instruction and no display command is received, the PRT 102 will receive the alternate game play instruction (step 532) being routed for a second recipient as inputted in sketch or text format for encryption and transmission by following steps 516-518.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method for improving in-game communications comprising:

(a) activating a portable remote terminal for communicating wirelessly a real-time game play instruction to a second portable remote terminal or a wearable apparatus for improving in-game communications during a real, live sporting game on a field;

(b) receiving the real-time game play instruction for encryption by said portable remote terminal's microprocessor;

(c) encrypting said received game play instruction forming an encrypted signal containing the received game play instruction and converting said game play instruction to machine readable format using speech recognition means so that said converted game play instruction may be displayed in text or visual format where the game play instruction was received in audio format;

(d) transmitting in real-time said encrypted signal containing the received game play instruction to either the second portable remote terminal or the wearable apparatus, whereby either recipient is notified by alarm notification means, wherein the game play instruction is intended for execution on a field by at least one live player during the real, live sporting game; and (e) providing means for either recipient to reject the received game play instruction whereby the second portable remote terminal and the wearable apparatus can transmit an alternate game play instruction, that is encrypted forming a second encrypted signal containing the alternate game play instruction for transmission to more than one recipient, who can reject the alternate game play instruction as received and provide a new alternate game play instruction.

2. The method of claim 1, further comprising displaying a plurality of game play instructions that are electronically stored thereon on said portable remote terminal's display element, from which the game play instruction may be provided for transmission.

3. The method of claim 2, wherein said plurality of game play instructions electronically stored thereon is stored in one or more of the following formats: visual and text.

4. The method of claim 1, wherein said received game play instruction may comprise of any one or more of the following formats: text, visual, sketch and audio.

5. The method of claim 4, wherein the step of receiving said game play instruction includes receiving a verbal game play instruction.

6. The method of claim 1, wherein said speech recognition means comprises of a user interface which includes an audio receiving circuit capable of receiving audio signals.

7. The method of claim 1, wherein said portable remote terminal may be used for any one or more of the following games, which includes: football, baseball, volleyball, soccer, paintball and basketball.

8. The method of claim 1, further comprising the step of communicating wirelessly with the second portable remote terminal or the wearable apparatus.

9. The method of claim 1, further comprising receiving an encrypted signal of a rejected game play instruction.

10. A method for improving in-game communications comprising:

(a) receiving, via a portable remote terminal, an encrypted signal containing a game play instruction from a first external source;

(b) decrypting said received encrypted signal containing said game play instruction and alerting recipient of said received encrypted signal containing said game play instruction via an alarm notification means of the portable remote terminal;

(c) activating a display element of the portable remote terminal for displaying said decrypted signal containing said received game play instruction;

(d) displaying said decrypted signal containing said game play instruction on said display element;

(f) receiving the game play instruction being routed to a second recipient for encryption by said portable remote terminal's microprocessor;

(g) encrypting said game play instruction being routed to the second recipient forming the encrypted signal containing said game play being routed to a second recipient and converting said game play instruction to machine readable format using speech recognition means so that said converted game play instruction may be displayed in text or visual format where the game play instruction was received in audio format, (h) transmitting said encrypted signal in real-time, wherein said game play instruction being routed to a second recipient is intended for execution on a field by at least one live player during a real, live sporting game; and (i) providing means for the second recipient to reject the received game play instruction whereby the second portable remote terminal and the wearable apparatus can transmit an alternate game play instruction that is encrypted forming an encrypted signal containing the alternate game play instruction for transmission to more than one recipient, who can reject the alternate game play instruction and provide a new alternate game play instruction.

11. The method of claim 10, wherein said received game play instruction may be received in any one or more of the following formats: text, visual, sketch and audio.

12. The method of claim 10, wherein said step of receiving game play instruction being routed to the second recipient for encryption further includes receiving an alternate game play instruction.

13. The method of claim 12, wherein said alternate game play instruction may include any one or more of the following: one of a plurality of game play instructions stored on said PRT, a text message, a visual, sketch or an verbal game play instruction.

14. The method of claim 12, further comprising receiving an alternate verbal game play instruction.

15. The method of claim 14, further comprising converting said alternate verbal game play instruction to machine-readable format using speech recognition means.

16. The method of claim 10, wherein the alarm notification means is capable of any one of the following: causing a vibration of said portable remote terminal, sounding an audio alarm and flashing a light, visual or text of the decrypted signal containing the game play instruction on the display element.

17. A system for improving in-game communications comprising:

(a) communication means for receiving an encrypted signal containing a game play instruction;

(b) microprocessor for decrypting said encrypted signal containing said game play instruction and alerting a recipient of the received game play instruction via a portable remote terminal's alarm notification means, and for encrypting said game play instruction to form the encrypted signal containing the game play instruction, and for converting said game play instruction to machine readable format using speech recognition means so that said converted game play instruction may be displayed in text or visual format where the game play instruction was received in audio format;

(c) activating means for activating a display element of the portable remote terminal for displaying said decrypted signal containing said game play instruction;

(d) display element for displaying said decrypted game play instruction thereon; and (e) communication means for transmitting in real-time said encrypted signal containing the game play instruction, wherein the game play instruction is intended for execution on a field by at least one live player during a real, live sporting game and the recipient's portable remote terminal or wearable apparatus includes means to reject the received game play instruction whereby the recipient's portable remote terminal and the wearable apparatus can transmit an alternate game play instruction that is encrypted forming a second encrypted signal containing the alternate game play instruction for transmission to more than one recipient, who can reject the alternate game play instruction and provide a new alternate game play instruction.

18. The system of claim 17, wherein said received game play instruction may be received in any one or more of the following formats: text, visual, sketch and audio.

19. The system of claim 17, wherein said communication means includes means for communicating wirelessly with the second portable remote terminal or the wearable apparatus.

20. The system of claim 19, wherein said alternate game play instruction may include any one or more of the following: one of a plurality of game play instructions stored thereon, a text message, a visual, sketch or a verbal game play instruction.

21. The system of claim 19, further comprising speech recognition for receiving an alternate verbal game play instruction and converting said alternate verbal game play instruction to machine-readable input.

22. The system of claim 17, wherein the alarm notification means is capable of any one of the following: causing a vibration of said portable remote terminal, sounding an audio alarm and flashing a light on the display element.

23. A system for improving in-game communications comprising:

(a) activating means for activating a portable remote terminal for communicating wirelessly a real-time game play instruction to a second portable remote terminal or a wearable apparatus for improving in-game communications during a real, live sporting game on a field;

(b) microprocessor for receiving the real-time game play instruction for encryption and for encrypting said received game play instruction forming an encrypted signal containing the received game play instruction and converting said game play instruction to machine readable format using speech recognition means so that said converted game play instruction may be displayed in text or visual format where the game play instruction was received in audio format;

(c) communication means for transmitting in real-time said encrypted signal containing the received game play instruction to either the second portable remote terminal or the wearable apparatus, whereby either recipient is notified by alarm notification means, wherein the game play instruction is intended for execution on a field by at least one live player during the real, live sporting game; and the recipient's portable remote terminal or wearable apparatus includes means to reject the received game play instruction whereby the second portable remote terminal and the wearable apparatus can transmit an alternate game play instruction that is encrypted forming a second encrypted signal containing the alternate game play instruction for transmission to more than one recipient, who can reject the alternate game play instruction and provide a new alternate game play instruction.

* * * * *